US012721448B2

(12) United States Patent
Leng

(10) Patent No.: US 12,721,448 B2
(45) Date of Patent: Sep. 1, 2026

(54) ELASTIC SUPPORT MODULE, ELASTIC PAD, AND FURNITURE

(71) Applicant: Luhao Leng, Xiamen (CN)

(72) Inventor: Luhao Leng, Xiamen (CN)

( * ) Notice: Subject to any disclaimer, the term of this patent is extended or adjusted under 35 U.S.C. 154(b) by 23 days.

(21) Appl. No.: 18/715,017

(22) PCT Filed: Dec. 2, 2022

(86) PCT No.: PCT/CN2022/136305

§ 371 (c)(1),
(2) Date: May 30, 2024

(87) PCT Pub. No.: WO2023/098892

PCT Pub. Date: Jun. 8, 2023

(65) Prior Publication Data

US 2025/0024959 A1 Jan. 23, 2025

(30) Foreign Application Priority Data

Dec. 2, 2021 (CN) ..... 202111459895.1

(51) Int. Cl.
*A47C 27/06* (2006.01)
*A47C 27/07* (2006.01)

(52) U.S. Cl.
CPC ..... *A47C 27/065* (2013.01); *A47C 27/07* (2013.01)

(58) Field of Classification Search
CPC ..... A47C 27/065; A47C 27/07; A47C 23/05; A47C 23/002; A47C 27/063
See application file for complete search history.

(56) References Cited

U.S. PATENT DOCUMENTS 122,111 A * 12/1871 Duffy ..... A47C 23/002 5/255
5,588,165 A * 12/1996 Fromme ..... A47C 23/002 5/255

(Continued)

FOREIGN PATENT DOCUMENTS

CN 206534409 U 10/2017
CN 107569000 A 1/2018

(Continued)

OTHER PUBLICATIONS

English translation of International Search Report for International Application No. PCT/CN2022/136305; Date of Mailing: Feb. 10, 2023; 3 pages.

*Primary Examiner* — J. T. Newton
(74) *Attorney, Agent, or Firm* — Perkins Coie LLP

(57) ABSTRACT

An elastic support module comprises a base and a plurality of elastic support strips arranged at an interval in a circumferential direction of the base. The first ends of the plurality of elastic support strips are disposed on the base, and the second ends of the plurality of elastic support strips are fixedly connected relative to each other by a connecting member to form an elastic support frame portion. With the elastic support modules assembled to form an elastic pad, the elastic support modules may be used in place of springs, with less weight and better elasticity and comfort. In addition, the plurality of elastic support modules may be easily disassembled and disassembled via the base, thereby facilitating the assembly and disassembly of the elastic pad.

16 Claims, 13 Drawing Sheets

(56) References Cited

U.S. PATENT DOCUMENTS

| | | | | |
|---|---|---|---|---|
| 6,113,082 | A * | 9/2000 | Fujino | F16F 1/025 267/110 |
| 6,427,990 | B1 * | 8/2002 | Hartmann | A47C 27/065 5/255 |
| 8,185,988 | B2 * | 5/2012 | Wieland | A47C 23/05 5/247 |
| 11,889,926 | B1 * | 2/2024 | Leng | A47C 23/005 |
| 12,239,231 | B2 * | 3/2025 | Leng | A47C 23/002 |
| 2002/0100118 | A1 * | 8/2002 | Mossbeck | A47C 23/005 5/255 |
| 2009/0014929 | A1 * | 1/2009 | Bock | A47C 27/065 267/179 |
| 2011/0179580 | A1 * | 7/2011 | Wieland | A47C 27/065 5/690 |
| 2012/0200018 | A1 * | 8/2012 | Paz | A47C 7/027 267/166.1 |
| 2021/0307531 | A1 | 10/2021 | Lee et al. | |
| 2025/0024959 | A1 * | 1/2025 | Leng | A47C 23/002 |
| 2025/0160531 | A1 * | 5/2025 | Leng | A47C 27/065 |
| 2025/0176733 | A1 * | 6/2025 | Leng | A47C 27/07 |

FOREIGN PATENT DOCUMENTS

| | | | |
|---|---|---|---|
| CN | 209983850 | U | 1/2020 |
| CN | 111248686 | A | 6/2020 |
| CN | 112674535 | A | 4/2021 |
| CN | 112674536 | A | 4/2021 |
| CN | 112674537 | A | 4/2021 |
| CN | 112674543 | A | 4/2021 |
| KR | 20170132418 | A | 12/2017 |
| WO | 2021073588 | A1 | 4/2021 |

* cited by examiner

ELASTIC SUPPORT MODULE, ELASTIC PAD, AND FURNITURE

FIELD

The present disclosure relates to the field of elastic pads, and in particularly to an elastic support module, an elastic pad and a furniture.

BACKGROUND

Most conventional large-sized furniture is not easily disassembled or reassembled, although this is frequently needed. Disassembly of a beds can be difficult. As a result, still usable beds are sometimes discarded instead of moving them.

A bed usually consists of a bed frame, an elastic pad, and an outer covering. A conventional elastic pad is usually a kind of one-piece, non-detachable, integral pad formed from a plurality of superimposed layers and springs. The integral pad is large in size and is not easy to disassemble and store.

A conventional separately-pocketed spring mattress is intended to avoid two or more people lying in bed at the same time from affecting each other (e.g., if a weight difference between two individuals is relatively large, one of them will inevitably affect the other when turning his or her body to a side or moving the body). In this type of mattresses, each of the springs is individually packaged in a pocket or sleeve made of a nonwoven fabric or other material. The outside of the arranged set of spring pockets is covered by a whole sheet of foam rubber by adhesion, gluing or the like to form a furniture pad or a desired elastic pad in the form of the furniture pad. However, the separately-pocketed spring mattress is still an integral product that cannot be disassembled after leaving the factory and is not easily transported. In addition, in the separately-pocketed spring mattress, non-woven fabrics used for wrapping the pocketed springs are adhered to each other, and when the mattress is pressed, the plurality of pocketed springs cannot move up and down completely separately, thereby affecting the comfort of the mattress.

In addition, the conventional mattresses have a disadvantage that they are not easy to clean. For a typical mattress, only the outer covering is usually removable, and the sponge portion cannot be removed and not easily cleaned. Even though latex might have a certain anti-mite effect, the sponge portion that is not easily cleaned might cause a large hygienic hazard, since the mattress might be usually used for years.

SUMMARY

To address at least some of the problems existing in the prior art products, one of the objects of the present disclosure is to enable an elastic pad to reduce weight while maintaining good elasticity, to have better comfort, and to be assembled and disassembled conveniently.

In order to achieve the above object, in the first aspect, the present disclosure provides an elastic support module comprising a base and a plurality of elastic support strips arranged at an interval in a circumferential direction of the base, first ends of the plurality of elastic support strips being disposed on the base, and second ends of the plurality of elastic support strips being fixedly connected relative to each other by a connecting member so as to form an elastic support frame portion.

In the said technical solution, the elastic support module comprises the plurality of elastic support strips which are arranged at an interval in the circumferential direction of the base, and the first end of the plurality of elastic support strips are disposed on the base and the second ends are fixedly connected with one another by the connecting member. Thus, the plurality of circumferentially-spaced elastic support strips may enable the elastic support module to have a better elastic support effect. When such elastic support modules are assembled to form the elastic pad, the elastic support modules may be used in place of springs used in the elastic pad. The plurality of elastic support strips may enable the elastic pad to have a reduced weight while maintaining a better elasticity, and enable the elastic pad to have a better comfort. In addition, the plurality of elastic support modules may be easily disassembled and disassembled via the base, thereby facilitating the assembly and disassembly of the elastic pad.

In some embodiments, the connecting member extends on a side of the elastic support frame portion away from the base to form a plane support portion.

In some embodiments, the connecting member comprises a top cover, wherein the second ends of the plurality of elastic support strips are connected to the top cover and arranged at an interval around the circumferential direction of the top cover, and wherein a surface of the top cover facing away from the base serves as the plane support portion.

In some embodiments, the second end of each elastic support strip is formed with a top cover side connecting tab which is provided with a top cover side elastic snap; a circumferential edge of the top cover is provided with a plurality of circumferentially-spaced snapping edges, and a connecting bayonet is formed on each of the snapping edges; wherein the top cover side elastic snap on the top cover side connecting tab at the second end of each elastic support strip can be pressed into a corresponding connecting bayonet.

In some embodiments, the connecting member comprises a connecting sheet, by which the second ends of every two oppositely-disposed elastic support strips of the plurality of elastic support strips are connected together to form a U-shaped structure with every two oppositely-arranged elastic support strips, wherein a surface on a side of the connecting sheet facing away from the base serves as the plane support portion.

In some embodiments, two oppositely-disposed elastic support strips and the connecting sheets are integrally formed.

In some embodiments, a plurality of the connecting sheets are stacked and fixedly connected together.

In some embodiments, a width of the connecting sheet gradually decreases from the middle to both ends.

In some embodiments, the elastic support strip is formed by an elastic support sheet.

In some embodiments, the width of the elastic support sheet gradually decreases from the first end to the second end of the elastic support sheet.

In some embodiments, a plurality of said elastic support strips are gradually gathered from the first end to the second end to form a frustoconical shape.

In some embodiments, each of said elastic support strips is an arc-shaped strip having a convex surface facing outward.

In some embodiments, the first end of each said elastic support strip is formed with a base side connecting tab, and a base side elastic snap is formed on the base side connecting tab; the base is provided with a plurality of circumferentially-spaced base connection bayonet; wherein the base side elastic snap on the base side connecting tab at the first end of each said elastic support strip can be pressed into a corresponding base connection bayonet.

In some embodiments, the first end of each said elastic support strip is formed with the base side connecting tab; a plurality of circumferentially-spaced circumferential stop flanges are provided on an upper surface of the base, and fitting notches are formed between adjacent circumferential stop flanges; wherein each base side connecting tab is snap-fitted into a corresponding fitting notch, and the base side connecting tabs are connected with the upper surface of the base.

In some embodiments, the base is formed with a nesting opening configured to allow at least a portion of the elastic support frame portion of one said elastic support module to pass through the nesting opening of another said elastic support module into the elastic support frame portion of the another elastic support module, such that a plurality of said elastic support modules can be nested together in sequence.

In a second aspect, the present disclosure provides an elastic pad comprising a bottom layer; a plurality of elastic support modules of any one as described in the above first aspect, wherein the base of each said elastic support module is disposed on the bottom layer; a balance pad disposed on the plurality of elastic support modules to constrain movement of the plurality of elastic support modules in a transverse direction of the bottom layer; a top pad layer laid on said balance pad; a side enclosure at least covering a plurality of said elastic support modules and said balance pad.

In this way, as described above, due to the use of the plurality of elastic support modules according to the present disclosure, it is possible to reduce the weight of the elastic pad while maintaining good elasticity and to make the elastic pad have a better comfort by virtue of the elastic support action of the plurality of elastic support strips of elastic support modules. In addition, the plurality of elastic support modules may be easily detached from the bottom layer via the base, thereby facilitating the assembly and disassembly of the elastic pad.

In some embodiments, the elastic pad is a mattress.

In a third aspect, the present disclosure provides a furniture comprising the elastic pad of any as described in the above second aspect. As stated above, the above elastic pad is used, the overall quality of the furniture is effectively improved.

It is evident that elements or features described in a single embodiment above may be used alone or in combination in other embodiments.

BRIEF DESCRIPTION OF THE DRAWINGS

In the figures, sizes and proportions do not represent sizes and proportions of actual products. The figures are merely illustrative, and certain unnecessary elements or features have been omitted for the sake of clarity.

DESCRIPTION OF REFERENCE NUMERALS

1—base, 2—elastic support strip, 3—elastic support frame portion, 4—plane support portion, 5—top cover, 6—top cover side connecting tabs, 7—top cover side elastic snap, 8—snapping edge, 9—connecting bayonet, 10—connection sheet, 11—elastic support sheet, 12—base side connecting tab, 13—base side elastic snap, 14—base connection bayonet, 15—circumferential stop flange, 16—fitting notch, 17—nesting opening, 18—bottom layer, 19—elastic support module, 20—balance pad, 21—top pad layer, 22—side enclosure, 23—elastic pad, 24—elastic pad layer, 25—surface cloth layer, 26—elastic support module mounting space, 27—strip—shaped mounting frame.

DETAILED DESCRIPTION OF EMBODIMENTS

Hereunder, the present disclosure will be described in detail with reference to the accompanying drawings. What have been described herein are merely preferred embodiments according to the present disclosure. Those skilled in the art can conceive of other ways of implementing the present disclosure on the basis of the preferred embodiments, and said other ways also fall within the scope of the present disclosure.

Figure 1:
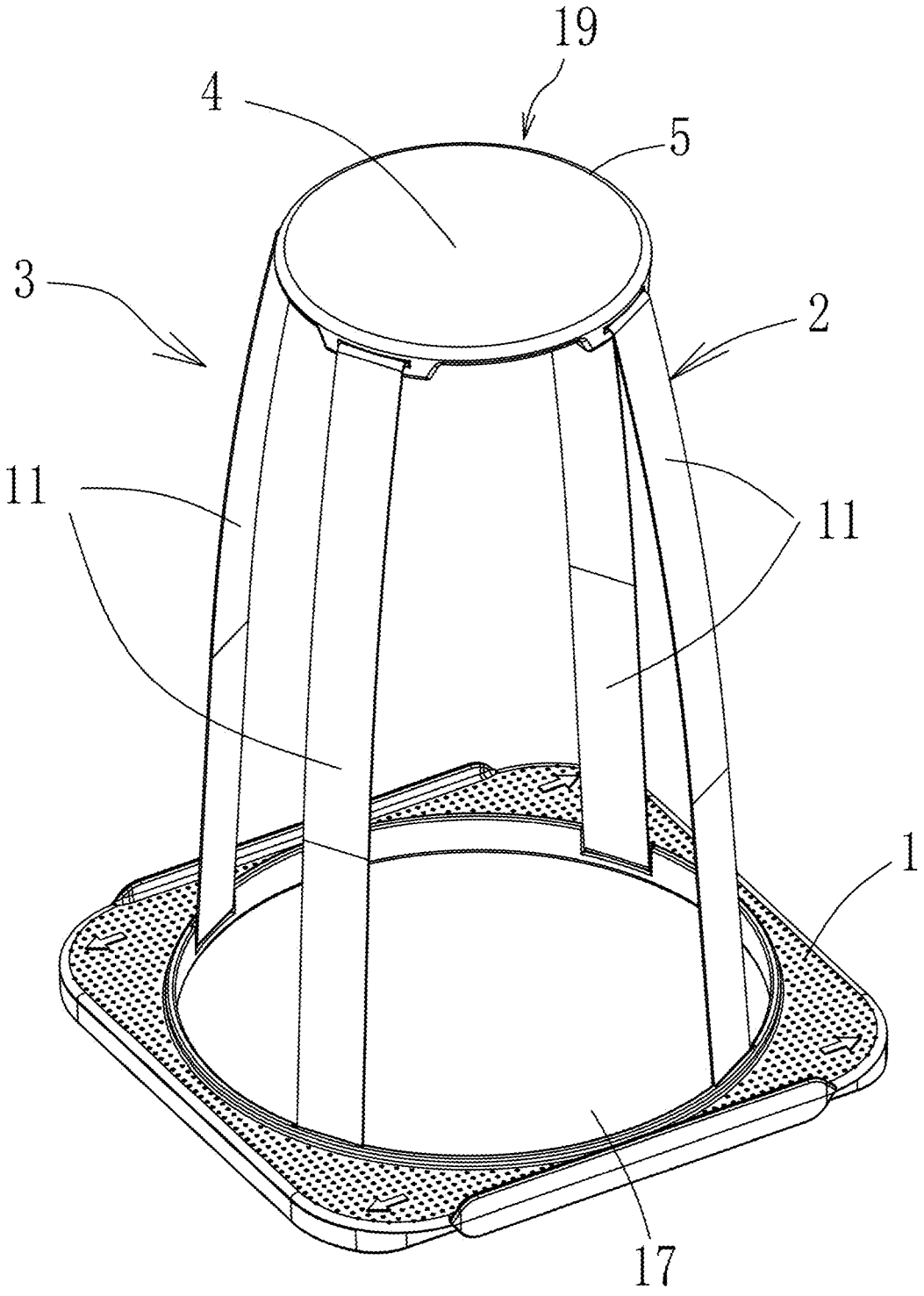
FIG. 1 is a perspective view illustrating a first elastic support module according to the present disclosure.
Figure 7:
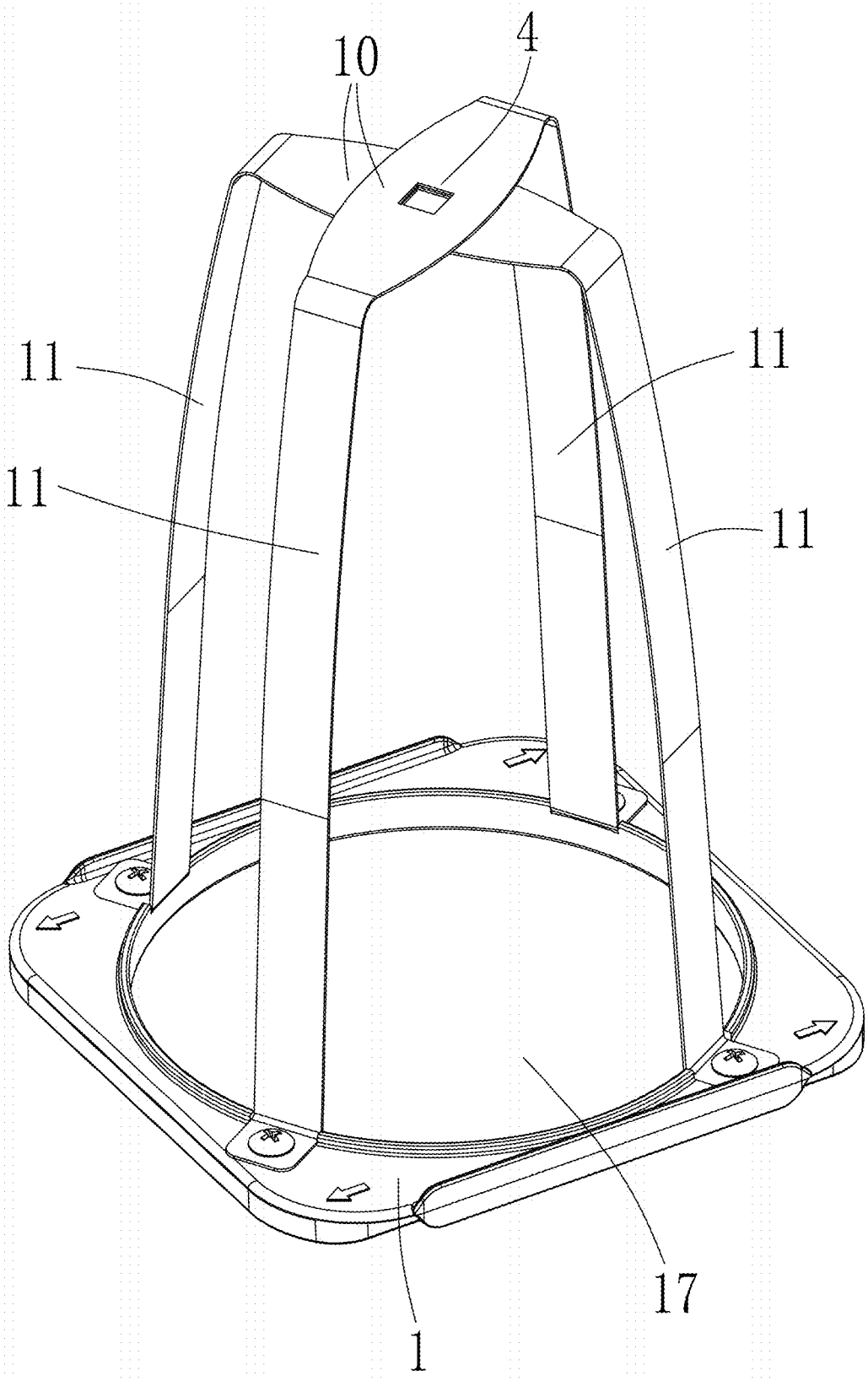
FIG. 7 is a perspective view illustrating a second elastic support module according to the present disclosure.

In a first aspect, referring to FIG. 1 and FIG. 7, the present disclosure provides an elastic support module 19 comprising a base 1 and a plurality of elastic support strips 2. The plurality of elastic support strips 2 are arranged at an interval in a circumferential direction of the base 1, the first end of each of the plurality of elastic support strips 2 is disposed on the base 1, and the second end of each of the plurality of elastic support strips 2 is fixedly connected with one another by a connecting member so as to form an elastic support frame portion 3.

In the elastic support module 19, since the elastic support module 19 comprises a plurality of elastic support strips 2 which are arranged at an interval in the circumferential direction of the base 1, and the first ends of the plurality of elastic support strips 2 are disposed on the base 1 and the second ends are fixedly connected with one another by a connecting member. Thus, the plurality of circumferentially-spaced elastic support strips 2 may enable the elastic support module 19 to have a better elastic support effect. When such elastic support modules 19 are assembled to form the elastic pad, the elastic support modules 19 may be used in place of springs used in the elastic pad. The plurality of elastic support strips 2 may enable the elastic pad to have a reduced weight while maintaining a better elasticity, and enable the elastic pad to have a better comfort. In addition, the plurality of elastic support modules may be easily disassembled and disassembled via the base, thereby facilitating the assembly and disassembly of the elastic pad.

In addition, the plurality of elastic support strips 2 may be arranged in the circumferential direction according to actual demands. For example, when the number of the plurality of elastic support strips 2 is small and the area of the base 1 is large, the plurality of elastic support strips 2 may be evenly spaced in the circumferential direction; when the area of the base 1 is small, the plurality of elastic support strips 2 may be unevenly arranged (the spacings between the elastic support strips 2 may be slightly different from one another). When the number of the plurality of elastic support strips 2 is large, the plurality of elastic support strips 2 may be arranged evenly at an interval in the circumferential direction or may be arranged unevenly at an interval in the circumferential direction.

Figure 6:
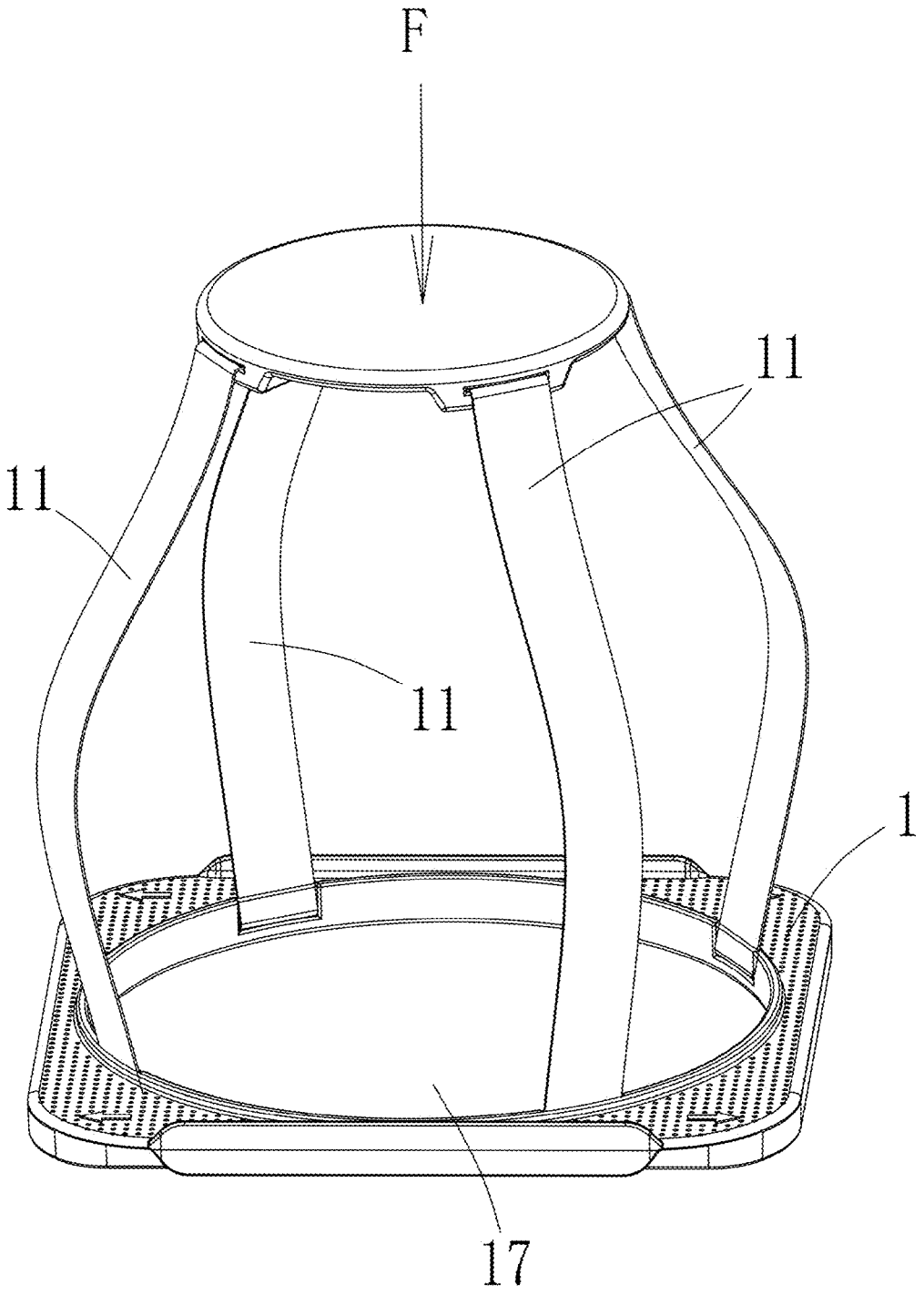
FIG. 6 is a schematic view showing that the elastic support module of FIG. 1 performs elastic supporting under action of a pressure F.

In addition, referring to FIG. 1, FIG. 6 and FIG. 7, in some embodiments, the connecting member extends on the side of the elastic support frame 3 away from the base 1 to form a plane support portion 4, that is, the connecting member extends in an end face of the elastic support frame 3 away from the base 1 (for example, an upper end face of the elastic support frame 3 of FIG. 1) to form the plane support portion 4. Thus, the plane support portion 4 may increase a pressure-receiving area of the elastic support module 19 under action of a pressure F, for example, the plane support portion 4 may increase the pressure-receiving and contacting area with a top surface pad layer 21 (to be described later) of the elastic pad, so that the plurality of elastic support strips 2 of the elastic support module 19 can be pressed and deformed more evenly, thereby improving the stability of the elastic support of the elastic support module 19.

Alternatively, in other optional embodiments, the connecting member may be a connecting strip, for example, a plurality of connecting strips are sequentially connected between the second ends of the adjacent elastic support strips 2 to connect the second ends of the plurality of elastic support strips 2 together, or an annular connecting strip extends circumferentially around the second ends of the plurality of elastic support strips 2 to connect the second ends of the plurality of elastic support strips 2 together. The annular connecting strip may be connected to outside surfaces, inside surfaces or end faces of the second ends of the plurality of elastic support strips 2.

Figure 2:
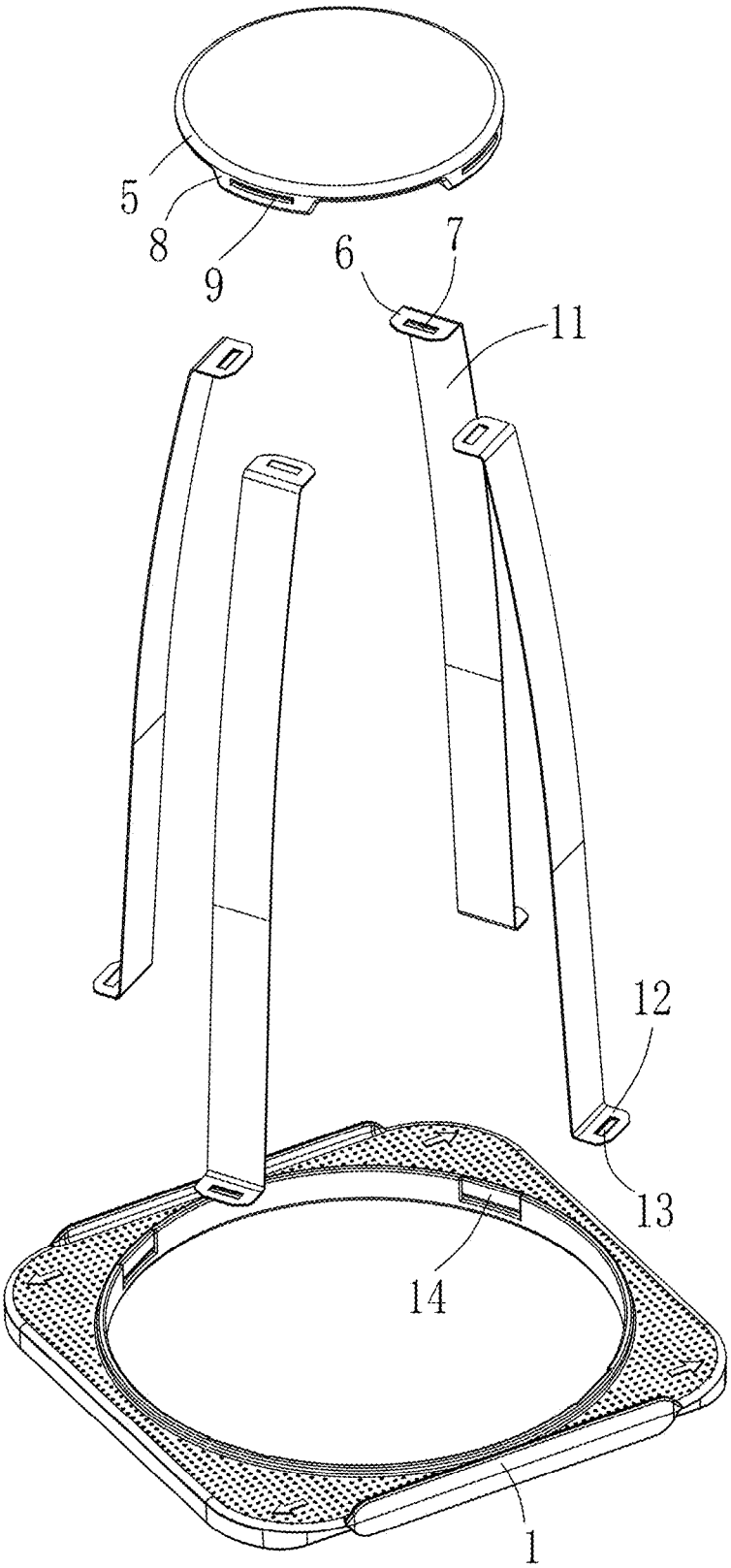
FIG. 2 is an exploded view of the elastic support module of FIG. 1.

In addition, in some embodiments, the connecting member may be in various types. For example, in one type of the connecting member, the connecting member may be the plurality of connecting strips or the annular connecting strip as described above. In another type of the connecting member, referring to FIG. 1 and FIG. 2, the connecting member comprises a top cover 5, the second ends of the plurality of elastic support strips 2 are connected to the top cover 5 and arranged at an interval around the circumferential direction of the top cover 5. A surface of the top cover 5 facing away from the base 1 (an outside surface of the top cover 5) serves as the plane support portion 4. Thus, in actual use, the entire outside surface of the top cover 5 will be subjected to the pressure F, as shown in FIG. 6, so that the plurality of elastic support strips 2 can be elastically deformed more uniformly to provide the elastic support force.

Certainly, the second ends of the plurality of elastic support strips 2 may be coupled to the top cover 5 in multiple connecting manners. For example, in one connecting manner, the other ends of the plurality of elastic support strips 2 may be connected to an inside surface of the top cover 5 opposite to the outside surface by connecting members such as screws. Alternatively, in another connecting manner, with reference to FIG. 2, the second end of each elastic support strip 2 is formed with a top cover side connecting tab 6, a top cover side elastic snap 7 is formed on the top cover side connecting tabs 6, the top cover side elastic snap 7 is a separate snap connected to the top cover side connecting tab 6, or the top cover side elastic snap 7 may be formed by a part of the top cover side connecting tab 6 itself. For example, a bent seam may be cut on the top cover side connecting tab 6, and then the cut part may be turned to a side of the top cover side connecting tab 6 by a predetermined angle so as to form the top cover side elastic snap 7; meanwhile, a circumferential edge of the top cover 5 is provided with a plurality of circumferentially spaced snapping edges 8, and a connecting bayonet 9 is formed on each of the snapping edges 8; wherein the top cover side elastic snap 7 on the top cover side connecting tab 6 at the second end of each elastic support strip 2 can be pressed into the corresponding connecting bayonet 9, for example, the top cover side connecting tab 6 at the second end of each elastic support strip 2 can be embedded into the corresponding connecting bayonet 9 so that the top cover side elastic snap 7 can be snap-fitted onto the inside surface of the connecting bayonet 9. As such, since the top cover side elastic snap 7 can be snap-fitted on the inside surface of the connecting bayonet 9, the second ends of the plurality of elastic support strips 2 are stably and reliably snap-fitted on the top cover 5.

Figure 3:
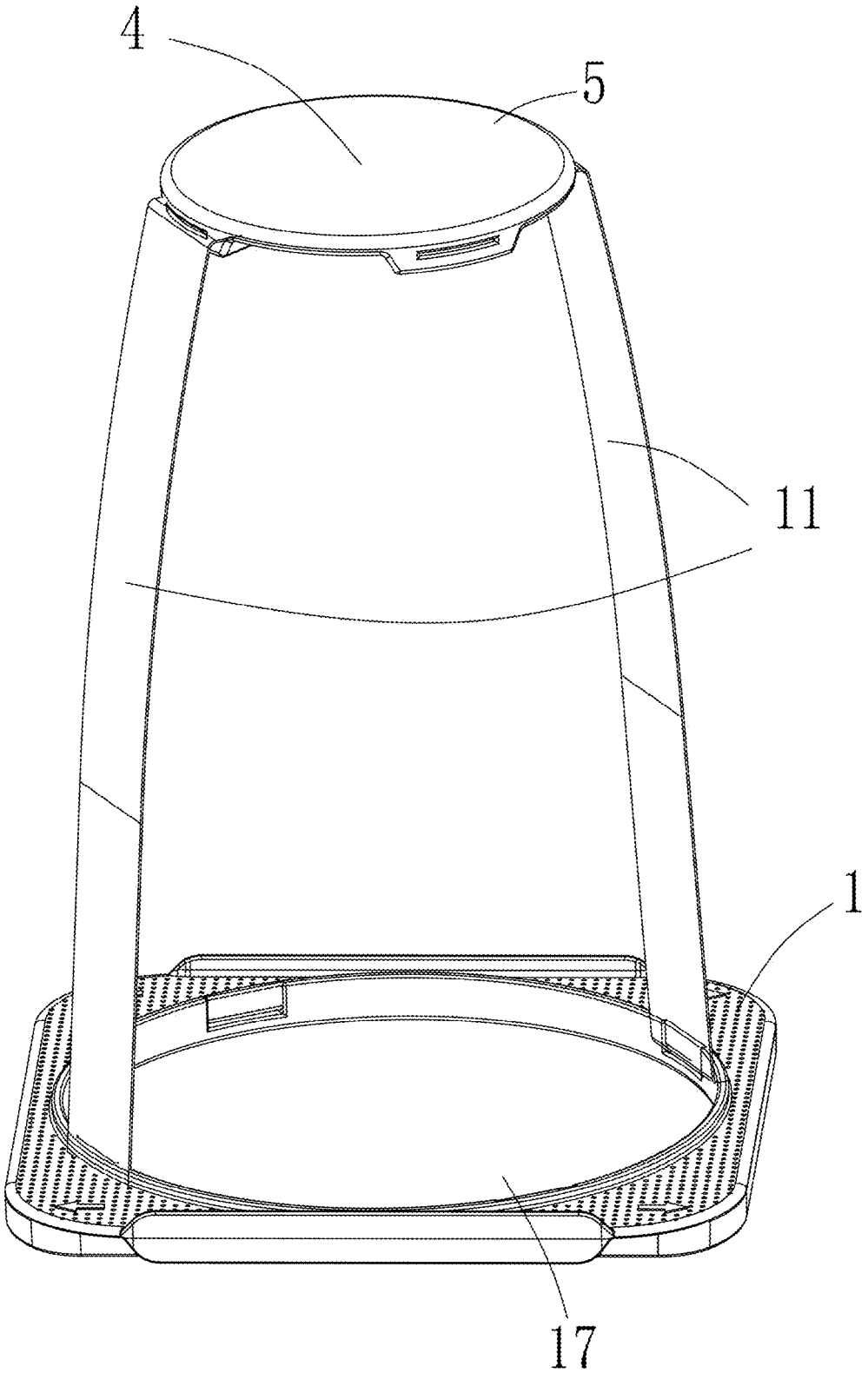
FIG. 3 is a perspective view of the elastic support module of FIG. 1 having two elastic support sheets.
Figure 4:
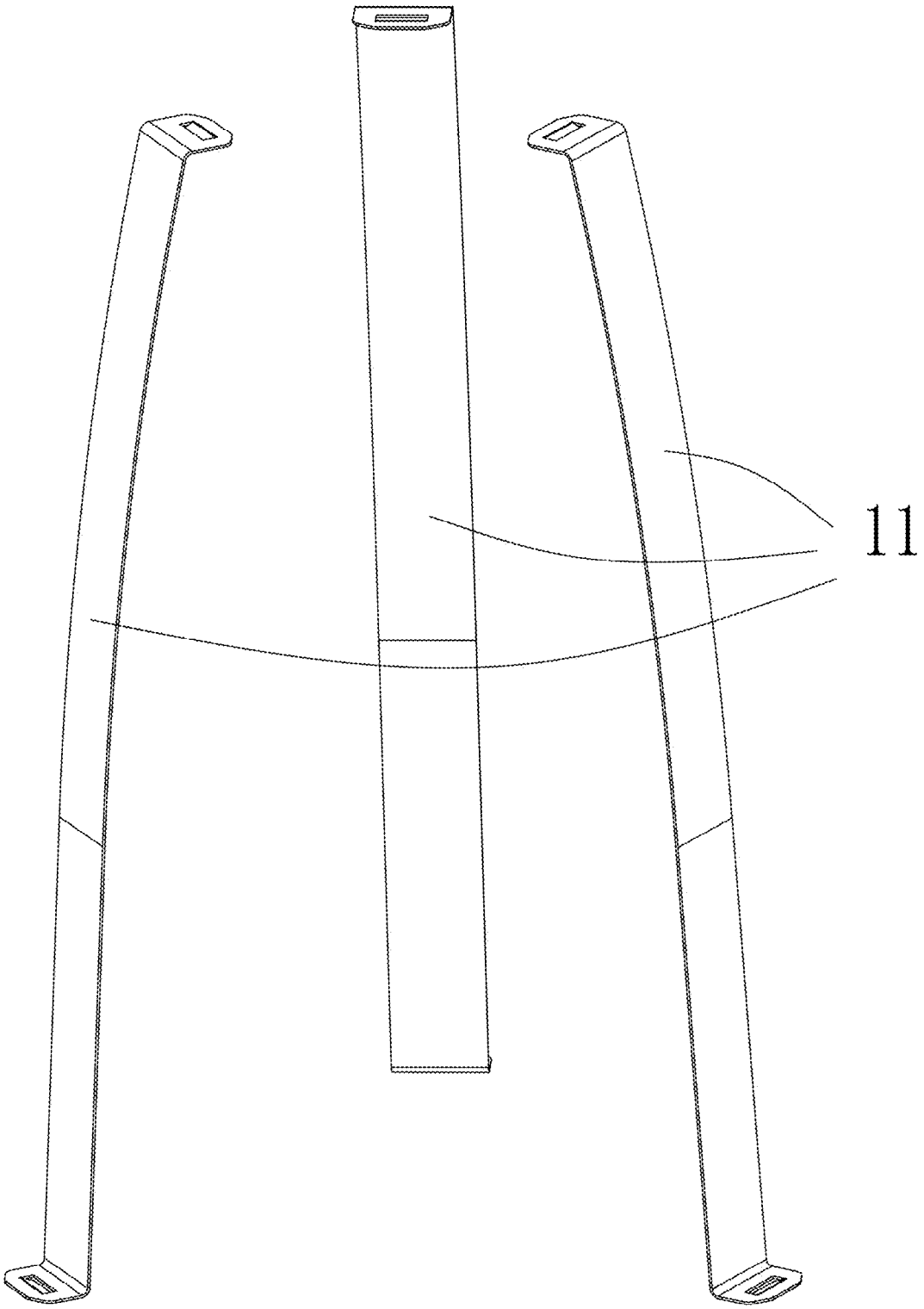
FIG. 4 is a schematic view showing three elastic support sheets.
Figure 5:
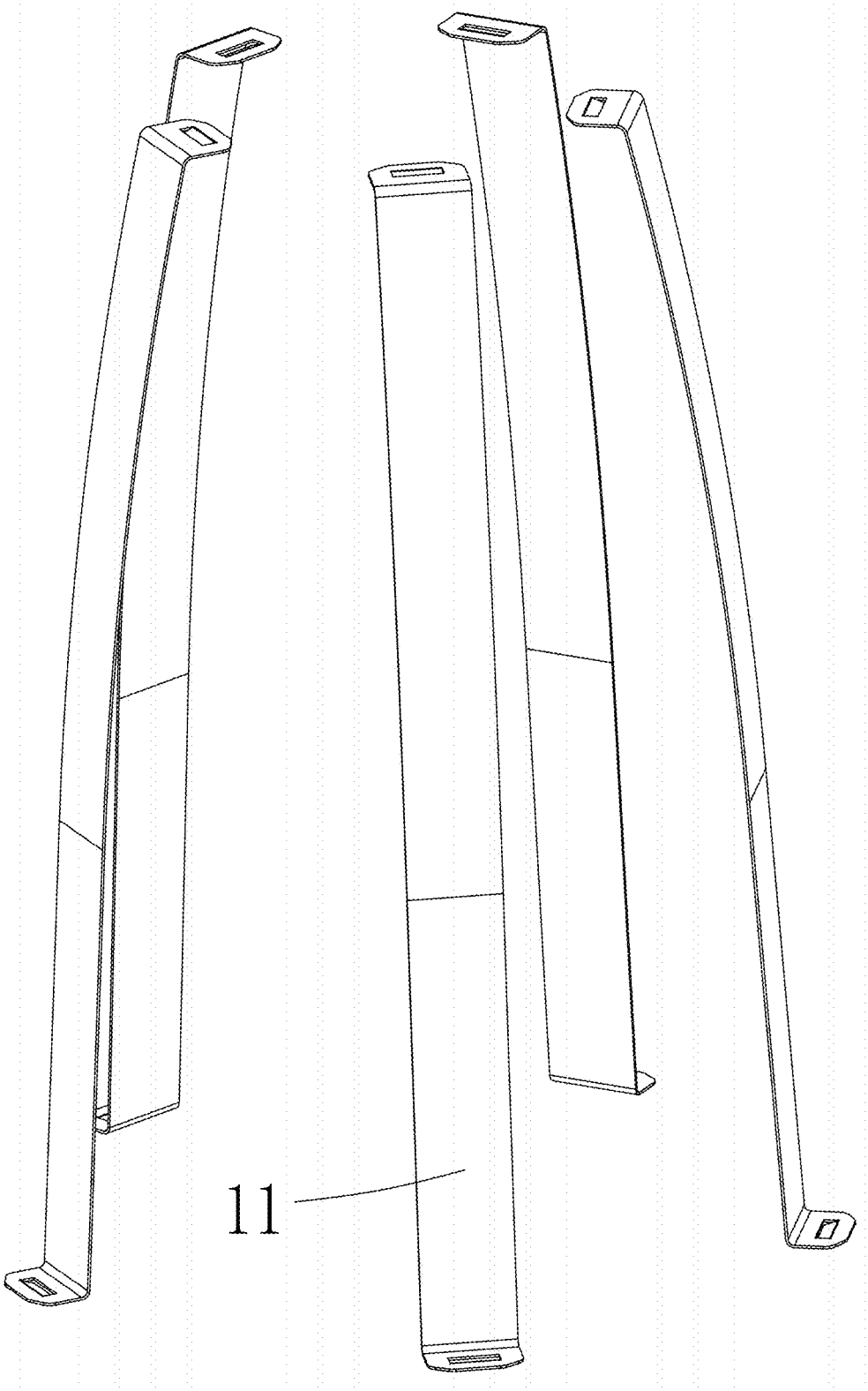
FIG. 5 is a schematic view showing five elastic support sheets.

In addition, the number of the elastic support strips 2 may be selected according to actual elastic support demands, for example, four elastic support strips 2 are shown in FIG. 1, two elastic support strips 2 are shown in FIG. 3, three elastic support strips 2 are shown in FIG. 4, and five elastic support strips 2 are shown in FIG. 5. Certainly, the number of the elastic support strips 2 may be six or more.

Figure 8:
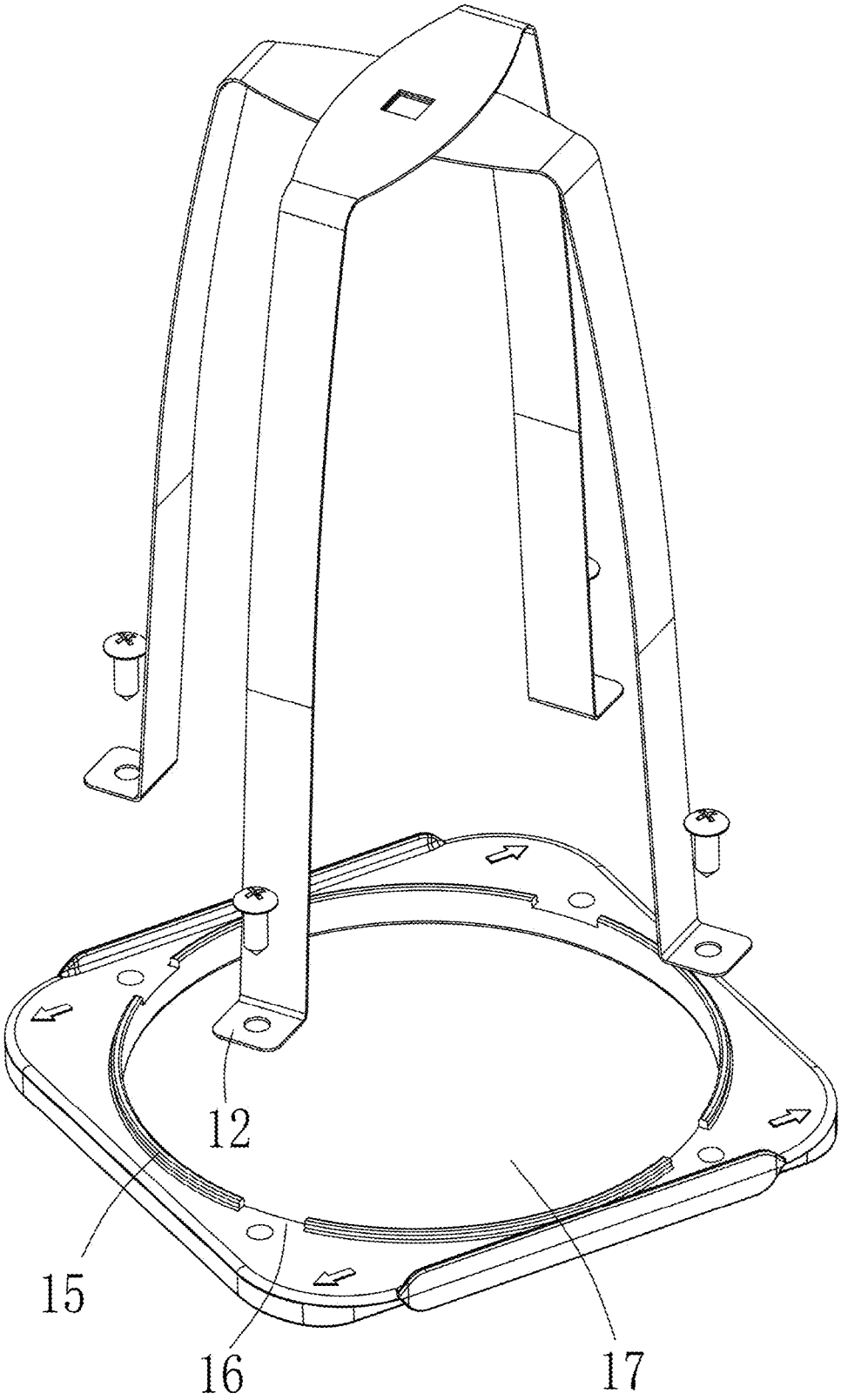
FIG. 8 is an exploded view of the elastic support module of FIG. 7.
Figure 9:
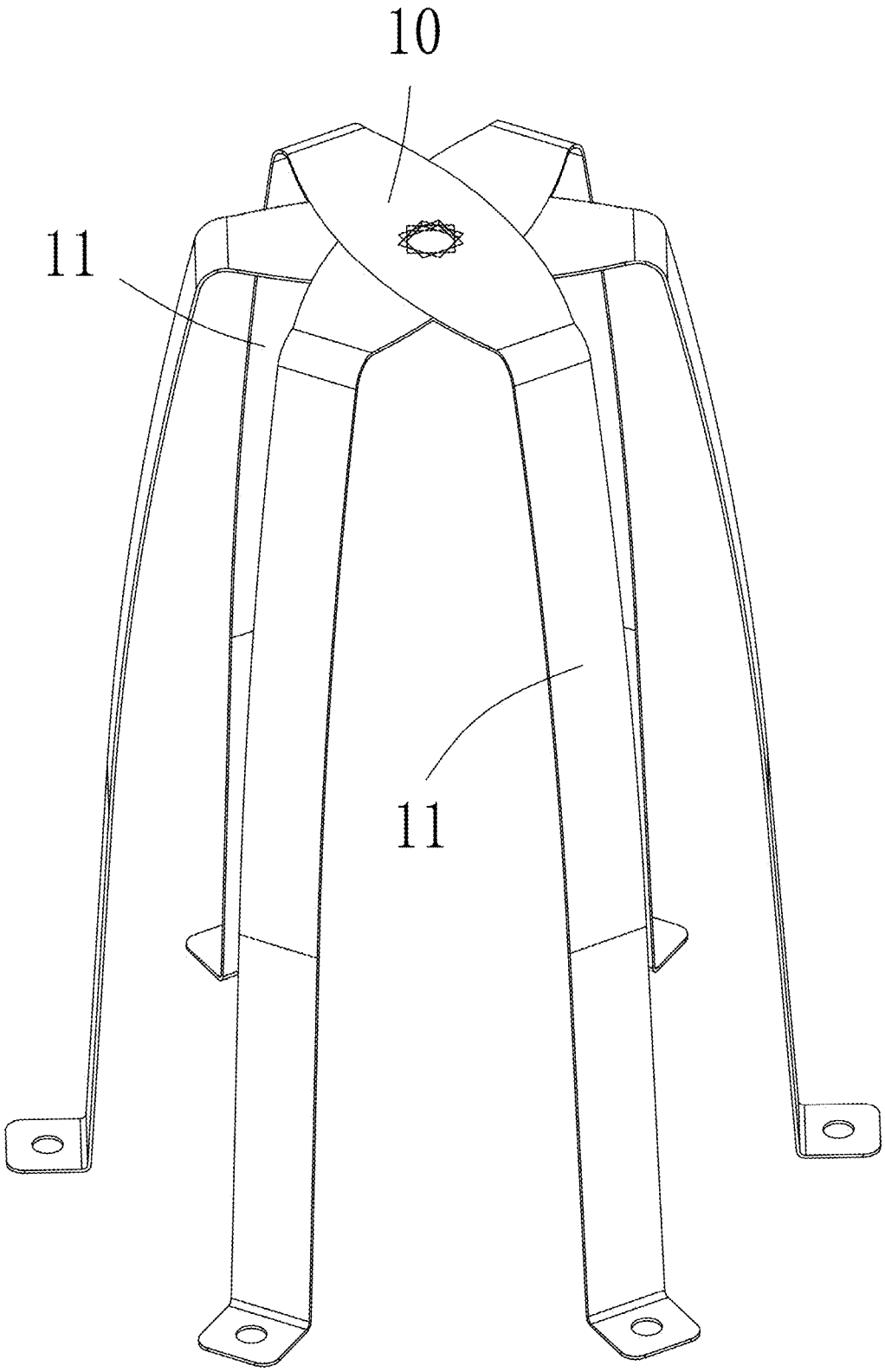
FIG. 9 is a schematic view showing the elastic support module of FIG. 7 has three U-shaped structures.

In addition, in other types of the connecting member, referring to FIG. 7, FIG. 8 and FIG. 9, the connecting member comprises a connecting sheet 10 by which the second ends of every two oppositely-disposed elastic support strips 2 of the plurality of elastic support strips 2 are connected together to form a U-shaped structure with every two oppositely-disposed elastic support strips 2, wherein a surface on the side of the connecting sheet 10 facing away from the base 1 serves as the plane support portion 4. For example, the number of the elastic support strips 2 is two and the elastic support strips 2 are connected by the connecting sheets 10 to form one U-shaped structure; the number of the elastic support strips 2 is four and every two elastic support strips 2 are connected by the connecting sheets 10 to form two U-shaped structures.

In addition, the connecting sheet 10 may be a separate sheet, or two oppositely-disposed elastic support strips 2 and the connecting sheets 10 may be integrally formed, i.e., a unitary U-shaped structure including the two elastic support strips 2 and connecting sheets 10 is formed by bending a single strip-shaped sheet.

In addition, in other types of connecting members, the connecting member may comprise a mesh sheet, and the second ends of the plurality of elastic support strips 2 may be respectively connected to the mesh sheet. The mesh sheet may be a plurality of strip-shaped sheets, one end of each of the plurality of strip-shaped sheets being connected to a central position, and the plurality of strip-shaped sheets extending radially.

In addition, when there are a plurality of connecting sheets 10, the plurality of connecting sheets 10 are stacked and fixedly connected together, for example, may be adhered together or riveted together by rivets. In this way, the plurality of coupling sheets 10 fixedly connected together may be restrained from moving relative to one another, so that deflection between the plurality of elastic support strips 2 connected thereto may be further restrained when being pressed. In addition, the plurality of connecting sheets 10 fixedly connected together may make the formed plane support portion 4 more stable, thereby avoiding change of the plane support portion 4 due to misalignment of the plurality of connecting sheets 10.

In addition, the connecting sheet 10 may have various shapes. For example, a width of the connecting sheet 10 remains the same from one end to the other end. Alternatively, referring to FIG. 7, FIG. 8 and FIG. 9, the width of the connecting sheet 10 is gradually reduced from the middle to both ends, so that the plane support portion 4 having a larger area and extending from the center of the end face to the circumference may be formed in the end face of the elastic support frame portion 3 away from the base 1.

In addition, in some embodiments, the elastic support strip 2 may be a circular bar body. Alternatively, in some embodiments, referring to FIG. 1 and FIG. 7, the elastic support strip 2 may be formed by the elastic support sheet 11 so that the elastic support sheet 11 can effectively reduce the weight of the elastic support module while providing a desired elastic support performance.

In addition, in some embodiments, the width of the elastic support sheet 11 may be the same from the first end to the second end of the elastic support sheet 11. Alternatively, in some embodiments, the width of the elastic support sheet 11 is gradually reduced from first end to the second end of the elastic support sheet 11. As such, in practical use, when the elastic support modules are placed in a vertical direction, a wider lower portion of the elastic support sheet 11 may provide an excellent support foundation, so that the elastic support module may have an excellent elastic support performance.

In addition, in some embodiments, referring to FIG. 1 and FIG. 7, a plurality of elastic support strips 2 are gradually gathered from the first end to the second end to form a frustoconical shape. Thus, in practical use, when the elastic support module is placed in the vertical direction, the plurality of elastic support strips 2 can be deformed more stably and reliably to provide more stable and reliable elastic support performance by virtue of the structural features of the frustoconical shape with a large bottom and a small top. Alternatively, in other embodiments, the plurality of elastic support strips 2 may extend vertically such that the elastic support frame 3 is formed as a cylinder.

In addition, each elastic support strip 2 may extend straight without bending. Alternatively, referring to FIG. 1 and FIG. 7, each of the elastic support strips 2 is an arc-shaped strip having a convex surface facing outward, so that the arc-shaped strips makes it easier to form the elastic support frame 3 into the frustoconical shape and also easy to provide stable and reliable deformation.

In addition, in some embodiments, the connection of the first end of each elastic support strip 2 and the base 1 may be accomplished by various connection structures. For example, in one connecting structure, with reference to FIG. 1 and FIG. 2, the first end of each elastic support strip 2 is formed with a base side connecting tab 12, a base side elastic snap 13 is formed on the base side connecting tab 12, and the base side elastic snap 13 may be a separate snap connected to the base side connecting tab 12, or the base side elastic snap 13 may be formed by a part of the base side connecting tab 12 itself. For example, a bent seam may be cut on the base side connecting tab 12, and then the cut part is folded towards a side of the base side connecting tab 12 by a predetermined angle so as to form the base side elastic snap 13; the base 1 is provided with a plurality of circumferentially-spaced base connection bayonets 14; wherein the base side elastic snap 13 on the base side connecting tab 12 at the first end of each elastic support strip 2 can be pressed into the respective corresponding base connection bayonet 14. For example, the base side connecting tab 12 at the first end of each elastic support strip 2 can be embedded into the respective corresponding base connection bayonet 14 so that the base side elastic snap 13 can be snap-fitted onto the inside surface of the base connection bayonet 14. In this way, since the base side elastic snap 13 can be snap-fitted onto the inside surface of the base connection bayonet 14, the first end of each of the plurality of elastic support strips 2 may be stably and reliably snap-fitted onto the base 1. For example, in another connecting structure, referring to FIG. 7 and FIG. 8, the first end of each elastic support strip 2 is formed with the base side connecting tab 12; a plurality of circumferentially-spaced circumferential stop flanges 15 are provided on the upper surface of the base 1, and fitting notches 16 are formed between adjacent circumferential stop flanges 15; wherein each base side connecting tab 12 is snap-fitted into a corresponding fitting notch 16 and is limited by the circumferential stop flanges 15 on both sides, and the base side connecting tabs 12 are connected to the upper surface of the base 1, for example, by means of a screw connection or a welding connection.

Figure 10:
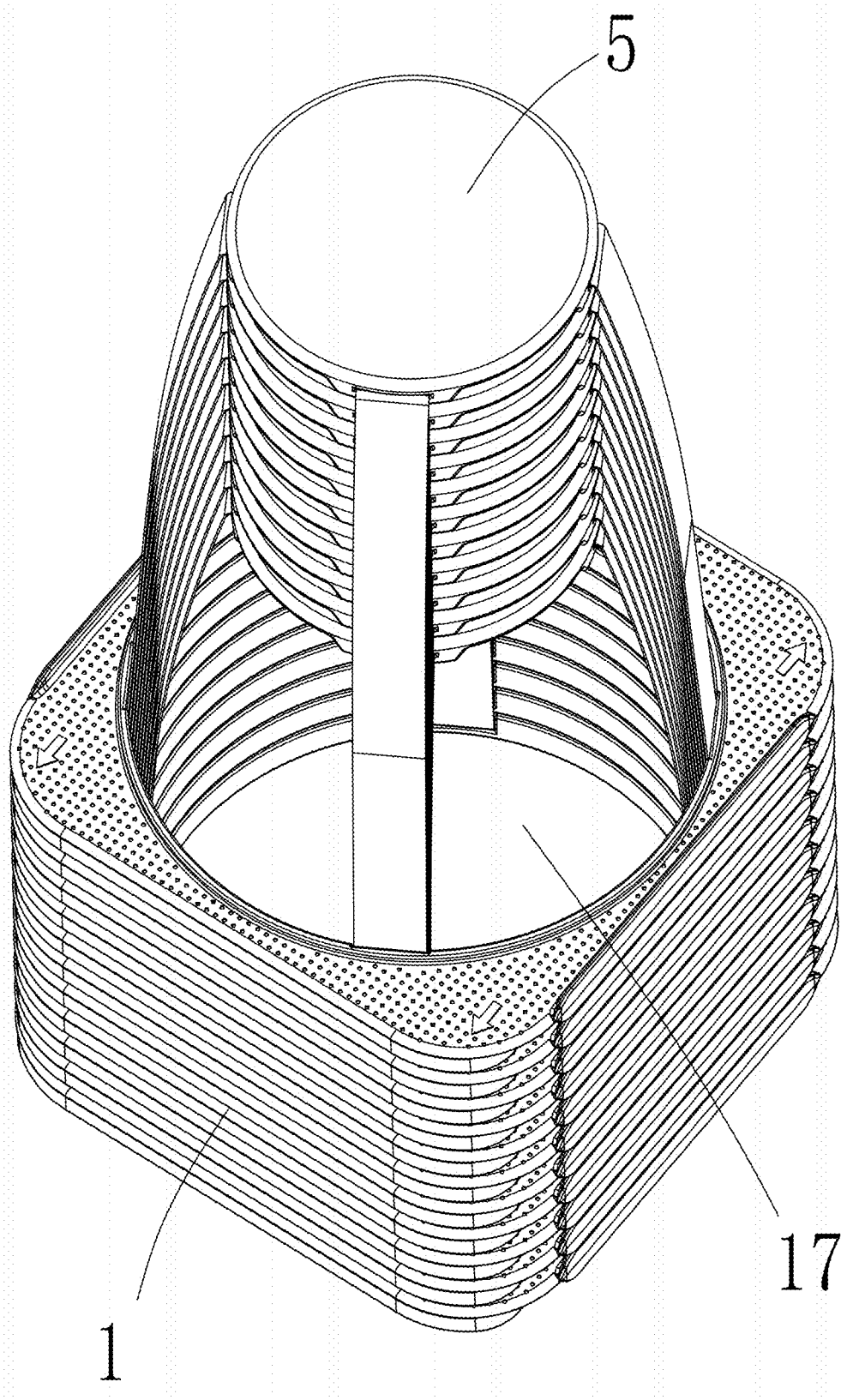
FIG. 10 is a schematic view showing that a plurality of elastic support modules of FIG. 1 are nested together in sequence.

In addition, in some embodiments, a bottom wall of the base 1 may be a one-piece bottom wall and not formed with a nesting opening 17. Alternatively, in some embodiments, referring to FIG. 1 and FIG. 7, the base 1 is formed with a nesting opening 17 configured to allow at least a portion of the elastic support frame portion 3 of one elastic support module to pass through the nesting opening 17 of another elastic support module into the elastic support frame portion 3 of the another elastic support module such that a plurality of elastic support modules may be nested together in sequence. As such, as shown in FIG. 10, sequential nesting and stacking of a plurality of elastic support modules may be achieved for ease of transport and storage.

In addition, the elastic support strip 2 such as the elastic support sheet 11 may be a plastic body that may be elastically deformed to support and recover the deformation or may be a metal member made of the same material as the spring. In addition, the base 1 and the connecting member may be made of a plastic material or a metal material.

Figure 11:
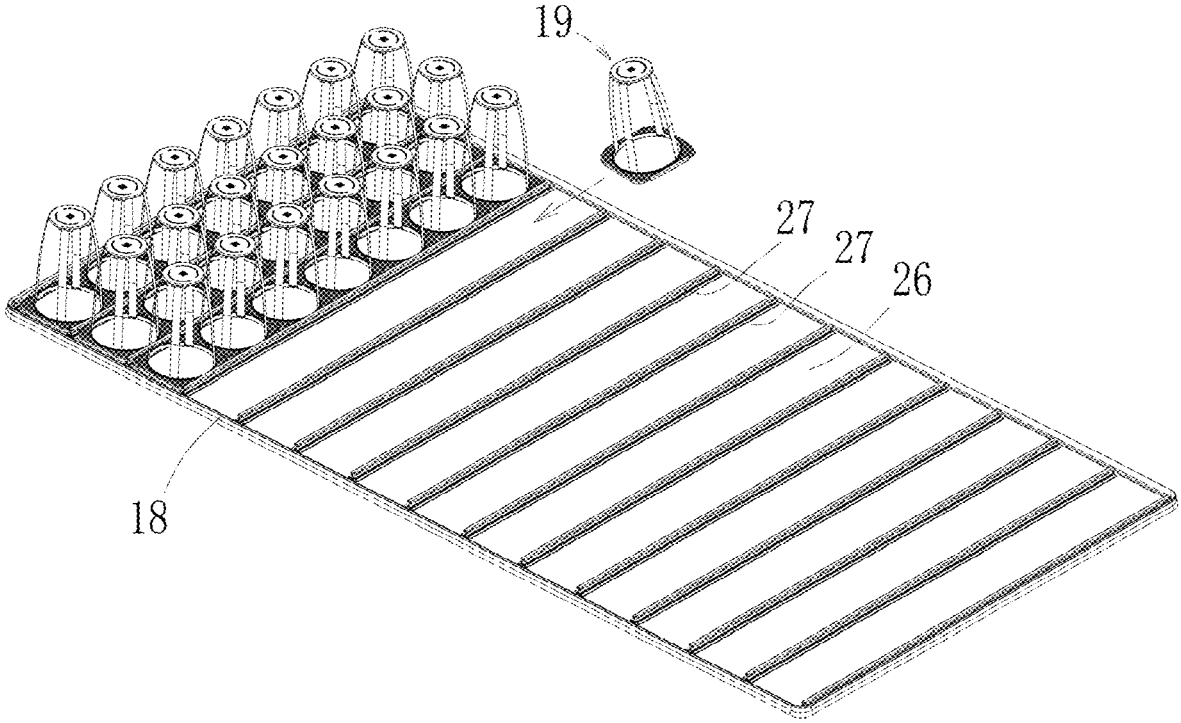
FIG. 11 is a schematic view showing that the elastic support modules of FIG. 1 are disposed on a bottom layer of an elastic pad.
Figure 12:
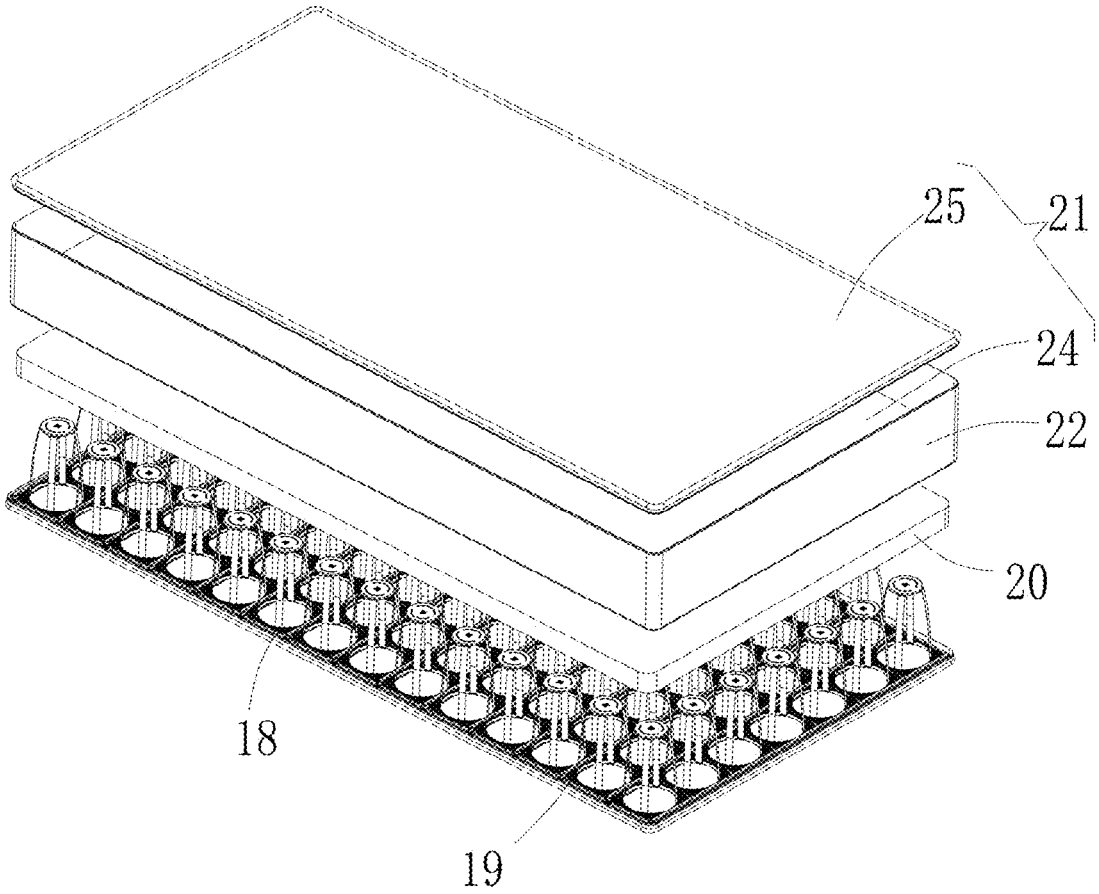
FIG. 12 exemplarily illustrates an exploded view of an elastic pad according to the present disclosure.
Figure 13:
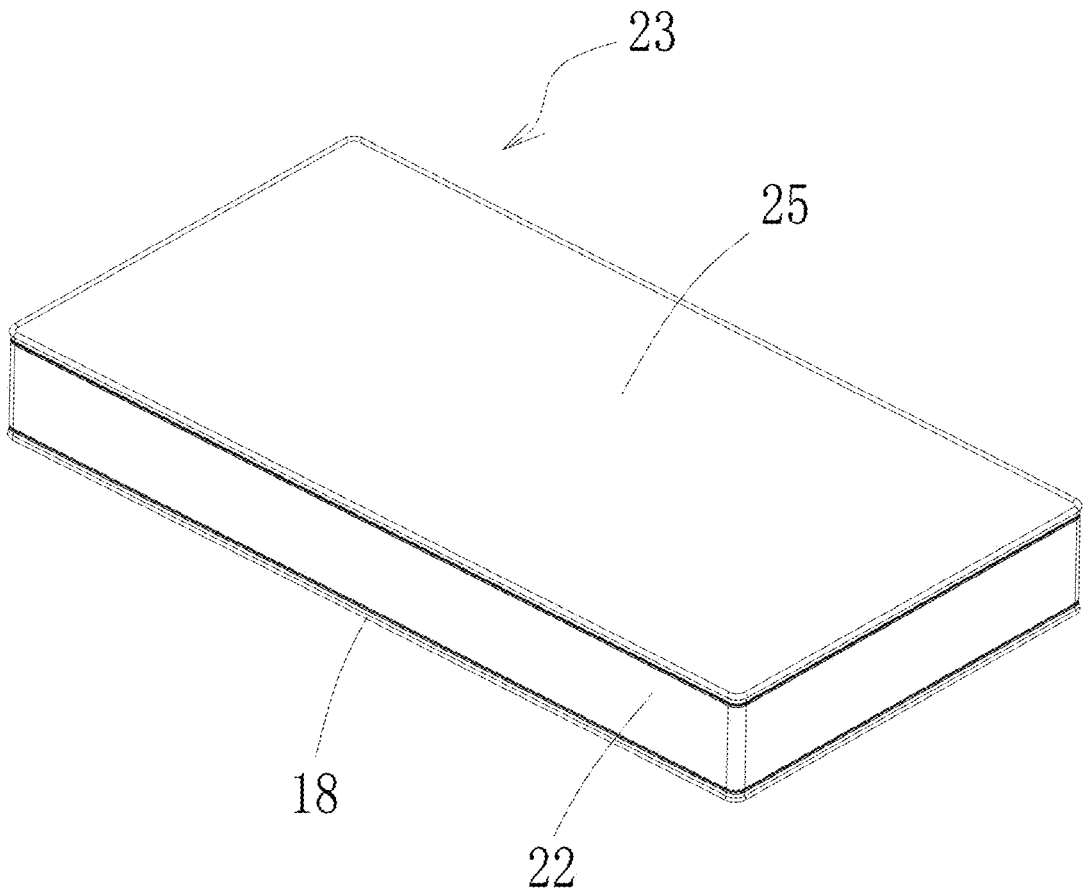
FIG. 13 is a schematic view showing of the elastic pad of FIG. 12 is in an assembled state.

In a second aspect, the present disclosure provides an elastic pad 23. Referring to FIG. 11, FIG. 12 and FIG. 13, the elastic pad 23 comprises a bottom layer 18, a plurality of elastic support modules 19 of any one as described in the above first aspect, a balance pad 20, a top pad layer 21 and a side enclosure 22, wherein the base 1 of each elastic support module 19 is disposed on the bottom layer 18, the balance pad 20 is disposed on the plurality of elastic support modules 19 to constrain a movement of the plurality of elastic support modules 19 in a transverse direction of the bottom layer 18, the top pad layer 21 is laid on the balance pad 20, and the side enclosure 22 at least covers the plurality of elastic support modules 18 and the balance pad 20.

As such, as described above, due to the use of the plurality of elastic support modules 19 according to the present disclosure, it is possible to reduce the weight of the elastic pad while maintaining good elasticity and to make the elastic pad have a better comfort by virtue of the elastic support action of the plurality of elastic support strips of elastic support modules. In addition, the plurality of elastic support modules may be easily detached from the bottom layer via the base, thereby facilitating the assembly and disassembly of the elastic pad.

In the elastic pad, the base 1 of each elastic support module 19 may be disposed on the bottom layer 18 in various manners. For example, in one manner, the base 1 of each elastic support module 19 may be connected to the bottom layer 18 by a connecting member such as a screw. Alternatively, in another manner, the base 1 of each elastic support module 19 may be inserted into a receiving counterbore at an upper end of the bottom layer 18. Alternatively, in other manners, with reference to FIG. 11, a plurality of strip-shaped mounting frames 27 arranged at an interval are provided on the bottom layer 18, an elastic support module mounting spaces 26 is formed between adjacent strip-shaped mounting frames 27, and a sliding groove is formed on the sides of the strip-shaped mounting frames 27, so that both ends of the base 1 of each elastic support module 19 may slide into the sliding grooves, so that a plurality of elastic support modules 19 may be sequentially slid into the elastic support module mounting spaces 26 fitted between adjacent strip-shaped mounting frames 27 as shown by arrow in FIG. 11.

In addition, the top pad layer 21 may be a single pad layer. Alternatively, as shown in FIG. 12, the top pad layer 21 may include an elastic pad layer 24 and a surface cloth layer 25, such that the elastic pad layer 24 may be laid on the balance pad 20, while the surface cloth layer 25 is laid on the elastic pad layer 24. A side enclosure 22 is connected between the bottom layer 18 and the surface cloth layer 25 to cover the elastic pad layer 24, the plurality of elastic support modules 18 and the balance pad 20. The elastic pad layer 24 may be a silicone pad layer or a cotton pad layer or a sponge pad layer such as a highly elastic sponge pad layer, or may be a flexible pad layer made of other materials.

In addition, the balance pad 20 may have any structure, but it should be noted that the plurality of elastic support modules 19 can be restrained from moving in the transverse direction of the bottom layer 18 regardless of the structure of the balance pad 20. For example, in one structure, the balance pad 20 is formed with counterbores, and upper ends of the plurality of elastic support modules 19 are respectively located in respective counterbores.

In addition, the elastic pad 23 may be used as a mattress, seat cushion, sofa cushion, or other pad bodies.

In a third aspect, the present disclosure provides a furniture comprising the elastic pad 23 of any as described in the second aspect. As stated above, the comfort and overall quality of the furniture is significantly improved due to the use of the above elastic pad. Such furniture comprises, but is not limited to, mattresses, sofas, chairs, sofa beds, soft-packaged benches, and the like.

The scope of protection of the present disclosure is defined only by the appended claims. Given the teaching of the present disclosure, those skilled in the art could easily envision using alternative structures of those disclosed herein as feasible alternative embodiments, and combining the embodiments disclosed herein to form new embodiments, which should all fall into the scope defined by the appended claims.

I claim:

1. An elastic support module comprising:

a plurality of elastic support strips each having a first end and a second end;

the first ends of the elastic support strips are detachably attached to a base and circumferentially spaced apart on the base; and the second ends of the elastic support strips are attached to each other by a connecting member; and wherein the plurality of elastic support strips provide resistance to compressive force exerted on the elastic support module.

2. The elastic support module of claim 1, wherein the connecting member forms a support plane vertically above the base.

3. The elastic support module of claim 1, wherein the connecting member comprises a top cover, and the second ends of the elastic support strips are circumferentially spaced apart around a perimeter of the top cover.

4. The elastic support module of claim 3, wherein the second end of each elastic support strip includes a tab having an elastic snap, the top cover has a plurality of circumferentially spaced apart snapping edges and a connecting bayonet on each snapping edge, each elastic snap configured to be pressed into one of the connecting bayonets.

5. The elastic support module of claim 1, wherein the elastic support strips extend towards each other from the base towards the connecting member to form a frustoconical shape.

6. The elastic support module of claim 1, wherein each elastic support strip has a convex outer surface.

7. The elastic support module of claim 1, further including a base connecting tab on the first end of each elastic support strip, and a base elastic snap on each base connecting tab; and a plurality of circumferentially spaced apart base connection bayonets on the base; each base side elastic snap configured to be pressed into one of the base connection bayonets.

8. The elastic support module of claim 1, wherein the first end of each elastic support strip has a base connecting tab; the base includes a plurality of stop flanges circumferentially spaced apart by fitting notches; wherein each base connecting tab is snap-fit into one of the fitting notches.

9. The elastic support module of claim 1, wherein the base has a nesting opening configured to allow at least a portion of the elastic support frame of a second elastic support module to pass through the nesting opening, for stacking the elastic support modules.

10. An elastic pad comprising:

a bottom layer;

a plurality of elastic support modules of claim 1, the base of each elastic support module on the bottom layer;

a balance pad on the plurality of elastic support modules to constrain movement of the plurality of elastic support modules;

a top pad layer on the balance pad; and a side enclosure at least covering a plurality of the elastic support modules and the balance pad.

11. The elastic pad of claim 10, wherein the elastic pad is a mattress.

12. Furniture comprising the elastic pad of claim 10.

13. An elastic support module comprising:

a plurality of pairs of elastic support strips;

each pair including first and second elastic support strips on opposite sides of a connecting sheet;

each elastic support strip having a bottom end detachably attached to a base and circumferentially spaced apart on the base; and each pair of elastic support strips forming a substantially inverted U-shaped elastic support frame; and wherein the plurality of elastic support strips provide resistance to compressive force exerted on the elastic support module.

14. The elastic support module of claim 13, wherein the first and second elastic support strips and the connecting sheet of each pair of elastic support strips is integrally formed.

15. The elastic support module of claim 13, the connecting sheets of the pairs of elastic support strips are stacked and connected.

16. The elastic support module of claim 13, wherein each connecting sheet has a first width at a middle of the connecting sheet and a second width away from the middle, wherein the first width is greater than the second width.

* * * * *